United States Patent [19]

Nuding

[11] Patent Number: 4,941,325

[45] Date of Patent: Jul. 17, 1990

[54] ENERGY EFFICIENT ELECTRONIC CONTROL SYSTEM FOR AIR-CONDITIONING AND HEAT PUMP SYSTEMS

[76] Inventor: Douglas J. Nuding, 1320 E. Crescent Cir., Mesa, Ariz. 85204

[21] Appl. No.: 402,850

[22] Filed: Sep. 6, 1989

[51] Int. Cl.[5] ..... F25D 17/00

[52] U.S. Cl. ..... 62/158; 62/179; 62/181; 62/182; 62/186

[58] Field of Search ..... 62/181, 179, 180, 182, 62/158, 157, 231, 186; 236/46 F, 11; 165/12

[56] References Cited

U.S. PATENT DOCUMENTS

| | | | |
|---|---|---|---|
| 3,695,054 | 10/1972 | Barry | 62/158 X |
| 3,890,798 | 6/1975 | Fujimoto et al. | 62/155 |
| 4,094,166 | 6/1978 | Jerles | 62/158 |
| 4,860,552 | 8/1989 | Beckey | 62/158 |

*Primary Examiner*—Harry B. Tanner
*Attorney, Agent, or Firm*—Harry M. Weiss

[57] ABSTRACT

An improved method and apparatus or control system for electronically sequencing the main components in central air-conditioning and heat pump systems normally comprising an outside fan motor, a compressor motor, and an inside blower motor, is disclosed. When comfort production or conditioned air is needed, the outside fan motor is initially turned on. After a predetermined programmable period of time, the compressor is turned on, and then, after another predetermined programmable period of time, the inside blower is turned on to deliver production air to the space or area being serviced. At the end of the comfort cycle, the outside and compressor motors are turned off while the inside blower motor continues to run for a third predetermined programmable period of time. The system and its method of operation provides the most energy efficient operation of central HVAC systems to date while simultaneously increasing protection to the various components of the system, increasing the amount of conditioned air produced per cycle, extending equipment life, and increasing comfort while simultaneously reducing energy consumption, duct loss and wasted energy use.

20 Claims, 1 Drawing Sheet

ENERGY EFFICIENT ELECTRONIC CONTROL SYSTEM FOR AIR-CONDITIONING AND HEAT PUMP SYSTEMS

BACKGROUND OF THE INVENTION

I. Field of the Invention

The present invention relates to a method and apparatus for maximizing the energy efficiency in the operation of conventional central air-conditioning and heat pump systems. More specifically, the present invention relates to conventional central air-conditioning and heat pump systems having a ductwork system, a condenser fan motor, a compressor motor, and a blower motor wherein energy efficiency is achieved by electronically sequencing the above-referenced motors for minimum starting energy consumption, limit reverse temperature gains, increased production output, added component protection, extended component life and increased user comfort.

II. Description of the Prior Art

Most conventional central air-conditioning and heat pump systems currently being manufactured and presently in use are designed to be controlled by a thermostat centrally located in the area of a building that it serves. This provides automatic stratified temperature control for a desired comfort setting. When the thermostat senses a temperature change in the conditioned area, it energizes an air-conditioning system that normally includes a condenser coil, a condenser fan, a condenser fan motor, a compressor, a compressor motor, an evaporator coil, a blower fan, and a blower motor all connected through a closed refrigerant circuit, and a ductwork system for supplying comfort air or conditioned air which is not normally inside the comfort area or space. When a conventional system is energized, all motors are turned on at the same time causing a large consumption of energy, an immediate reverse temperature gain into the conditioned area, followed by comfort air production. This is the current industry standard of operation today. During the cycle, there is a small amount of duct loss which increases as the comfort demand increases, so that the shortest cycle would satisfy the most efficient operation. When the thermostat is satisfied, all motors are normally turned off at the same time resulting in a large waste of cooling capacity left in the evaporator and production left or remaining in the ductwork system and wasted compressor energy use.

U.S. Pat. No. 3,415,071 discloses a problem which occurs during the start-up of an air-conditioning system where excessive pressure builds up, and the patent provides for an improvement for that single start-up problem by operating the condenser fan on high speed for a timed period at the beginning of each cycle. The system stills wastes a large amount of energy each cycle since all motors are still turned on and off at the same time.

U.S. Pat. No. 4,672,816 discloses another problem which exists during the start-up of an air-conditioning system, as first disclosed in U.S. Pat. No. 3,762,178; and the problem is described as a bad odor produced at the beginning of each new cycle. This patent provides an improvement for delaying the blower-on start-up. This would improve another single starting problem only, but the sytem wastes a large amount of energy each cycle as the condenser fan and the compressor motor are still turned on together, and all of the motors are still turned off at the same time.

U.S. Pat. No. 4,423,765 discloses a problem involving wasted cooling production at the end of the cooling cycle and provides an improvement by running the blower at the end of the cycle, but creates a serious new problem, first disclosed in U.S. Pat. No. 3,545,218, which relates to de-energizing the condensing unit for short periods of time during the cooling cycle when the system should be producing comfort or conditioned air. This causes non-cooling periods; a large consumption of energy to restart the hot condensing unit shortly after it was turned off; increased blower running time which increases duct loss and energy consumption; and all motors are still started at the same time thereby introducing further energy inefficiencies.

U.S. Pat. No. 4,094,166 includes the same disadvantages as those of the patents cited above, but attempts to correct the problems associated with the non-cooling periods wherein the condensing unit is de-energized for short periods of time by adding a temperature sensor switch that can override the timer of the short de-energized periods thereby shortening the timed de-energization periods and possibly causing a condition known as "short cycling", which is well-known to those skilled in the art, as well as still having all of the problems and energy inefficiencies normally resulting from starting all of the motors at the same time.

A 1988 White Rodgers product catalog, on pages 20 and 21, discloses two heat pump thermostats that list a feature they refer to as "Computed EMR TM Program (Energy Management Recovery)", which works in the cooling cycle only, thus providing a means to run the blower for 60 seconds after the cooling cycle. This would recover some of the cooling left in the evaporator and ductwork, but offers no recovery for heating at all, and all of the motors are still started at the same time with the resultant inefficiencies associated therewith.

The above-references all have precise limited merits and some advantages for air-conditioning systems, but none of them achieves the energy efficiency, added protection, extended equipment life, and increased occupant comfort, as does that of the present invention.

SUMMARY OF THE INVENTION

It is an object of the present invention to provide an electronic control system for controlling the components in conventional air-conditioning and heat pump units for operation at maximum energy efficiency, while simultaneously providing added protection to the main system components, extension of equipment life, and increased comfort production for the user.

It is another object of this invention to energize the condenser fan motor to pre-cool the condensing unit and to prevent a high-pressure and/or high stress, energy-inefficient, compressor start-up.

It is still another object of this invention to provide a means for energizing the compressor after a predetermined period of time for pre-cooling the evaporator and a portion of the air in the duct system so as to prevent a reverse temperature gain, to shorten the air production cycle, and to provide additional protection to the compressor and compressor motor.

It is yet another object of the present invention to provide a means for energizing the system's blower after a predetermined period of time for ensuring the immediate delivery of built-up fully-conditioned air while providing even greater protection for the blower motor.

It is a further object of this invention to provide a means for maintaining the system's blower on or energized for a predetermined period of time after the condensing unit is cycled off, whenever the automatic control means or thermostat determines that the user-selected temperature has been attained.

It is still a further object of this invention to provide an automatic control system for accomplishing all of the above-listed objectives simultaneously to maximize or optimize the energy efficiency of both existing and later manufactured air-conditioning or heat pump systems.

It is yet a further object of this invention to provide a method of operating a conventional air-conditioning or heat pump system so as to maximize the energy efficiency of the system, minimize the amount of electricity utilized to run the system, maximize the conditioned air output, extend component life and the life of the system, and maximize the quantity of conditioned air supplied to the desired space or area.

The present invention overcomes substantially all of the disadvantages of the prior art by providing an independent, electronic, staging process that sequences ALL of the motors on and off when it is most efficient for them to operate with a priority on improved energy efficiency of the complete or overall system, while leaving the temperature control function to the industry standard automatic control means (i.e. a thermostat) and increasing the user comfort.

The staging process of the control system of this invention is, as listed below:

A. The first stage energizes the condenser fan motor to pre-cool the condenser and compressor area or condensing unit and prevent a high-pressure or high stress compressor start-up;

B. The next stage energizes the compressor after a predetermined period of time to pre-cool the evaporator and part of the air duct system, to prevent a reverse temperature gain, to shorten the production cycle, and to give added protection to the compressor and compressor motor;

C. The next stage energizes the blower after a predetermined period of time to deliver a build-up of conditioned air, and to give added protection to the blower motor; and D. The next stage keeps the blower energized after the condensing unit cycles off whenever the automatic control means or thermostat is satisfied, thus providing substantially total comfort production or conditioned air recovery and energy utilization.

The above-referenced staging process is controlled and independently activated by a programmable electronic control circuit comprising the subject of the present invention.

Other objects and advantages of the present invention will become more apparent to those skilled in the art after reading the following Detailed Description of the Preferred Embodiment, the claims, and the Brief Description of the Drawings, as set forth hereinbelow.

DETAILED DESCRIPTION OF THE PREFERRED EMBODIMENT

Figure 1:
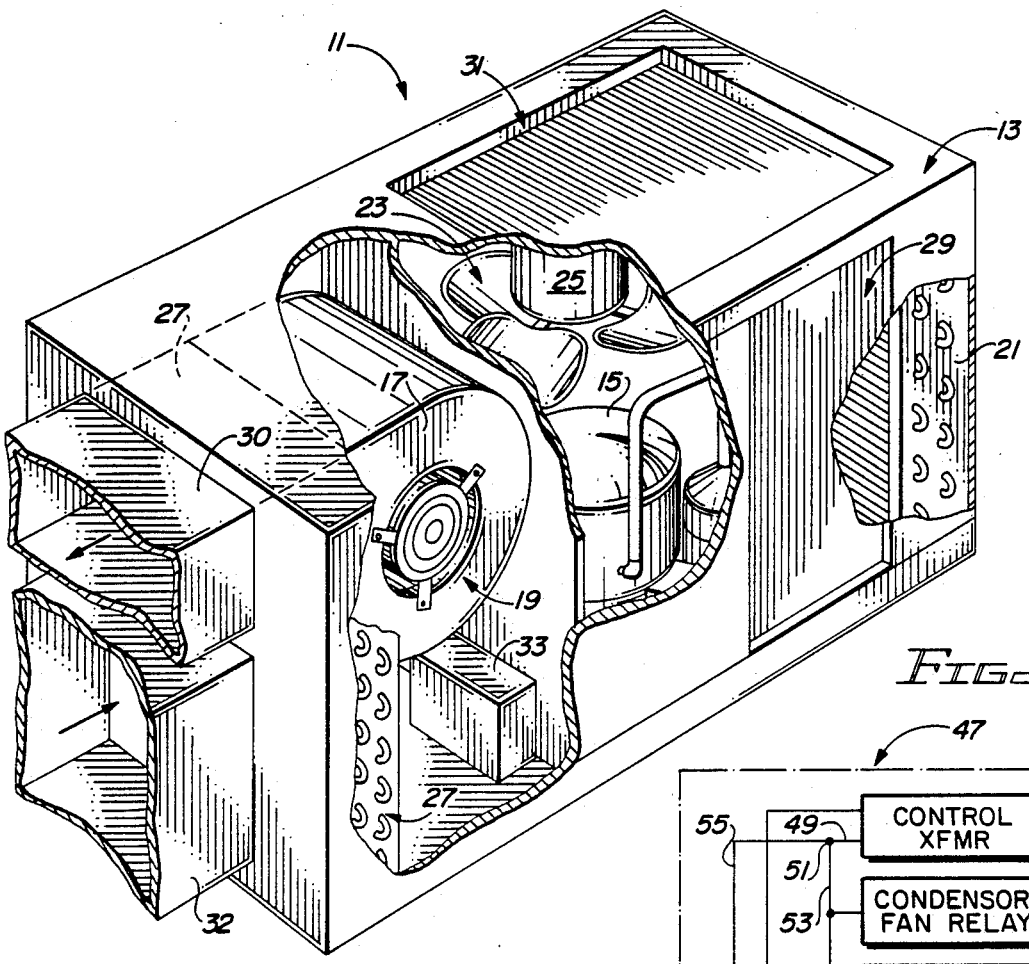
FIG. 1 is a perspective view, partially broken away, of a conventional air-conditioning unit or heat pump unit in which the control system of the present invention is used.

FIG. 1 shows a prior art air-conditioning or heat pump system 11 including a housing or cover 13, a compressor 15, a blower or system fan 17, a blower motor 19, a condenser 21, a condenser blower or condenser fan 23, a condenser blower motor 25, an evaporator 27, vents 29 and 31 to ambient air, a conditioned air output duct 30, a return air duct 32, and an electrical control box or circuit housing 33. All of these components are conventional, and all are well-known in the art. They are relatively basic to substantially all air-conditioning systems and heat pump systems. The conventional system circuitry and the improved energy efficient control system or circuit means of the present invention (as shown in FIG. 2) are represented as being enclosed or housed within the control box or housing 33 of FIG. 1.

Figure 2:
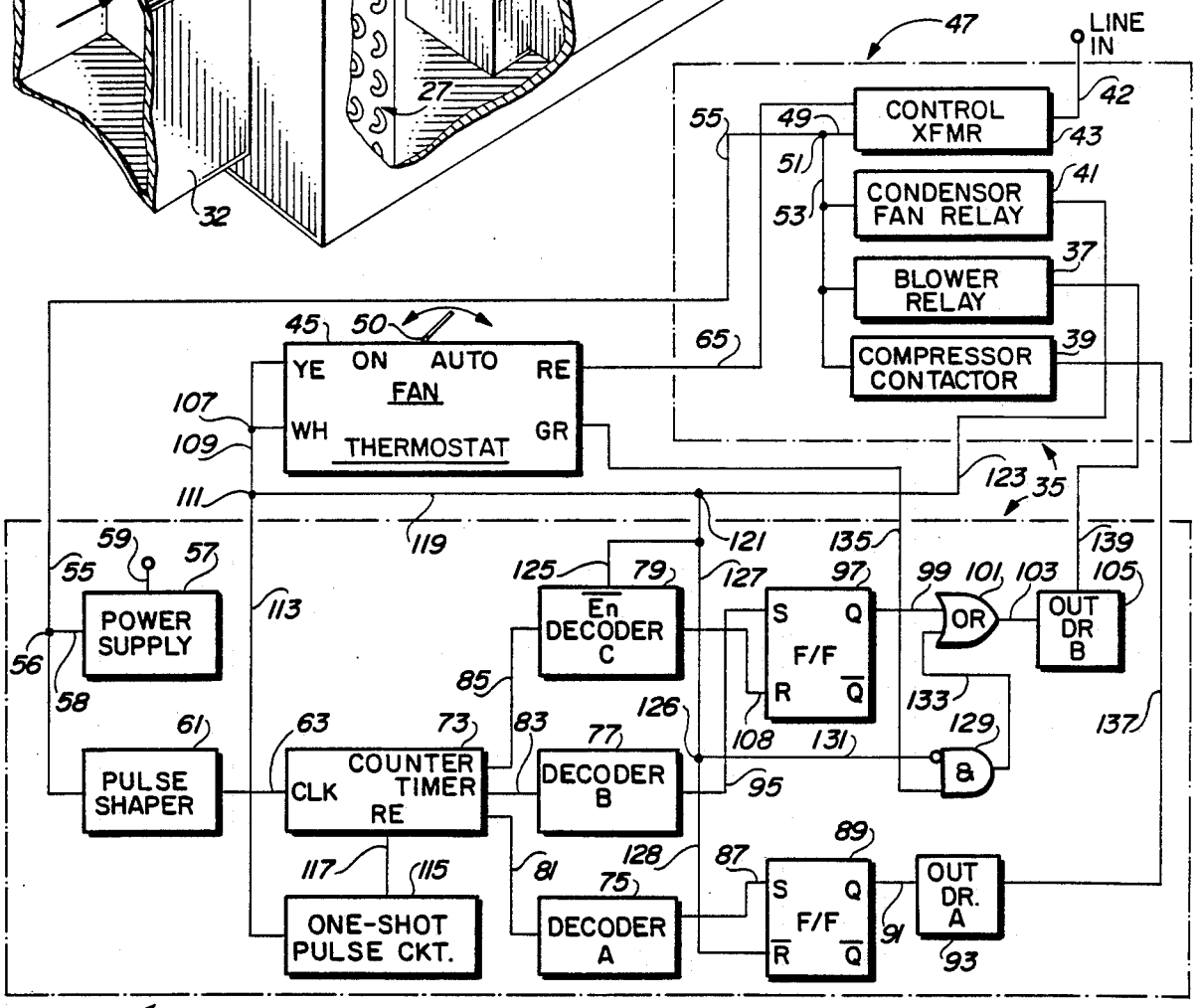
FIG. 2 is an electrical block diagram showing the electronic control system of the present invention as it is used to control the operation of the various components of the central air-conditioning or heat pump system of FIG. 1.

FIG. 2 is an electrical schematic block diagram illustrating the total control system 35 of the present invention. The total control system 35 contains conventional electrical components of a typical prior art system, as indicated by block 47, and the improved control system of the preferred embodiment of the present invention, as contained within block 40, as hereinafter described.

The conventionally well-known components of the electrical system 47 of prior art air-conditioning and heat pump systems is shown in FIG. 2 as including a blower relay 37, a compressor contactor 39, a condenser fan relay 41, which may have to be added to some air-conditioning systems presently in use, a control transformer 43 having an input adapted to receive AC line power via input lead 42 and having a continuous control voltage or secondary coil output via leads 49 and 65, output lead 49 is connected to node 51, to lead 53 which is used for the common in the control circuit of block 47. Output lead 65 is connected to an automatic control device or conventional thermostat 45.

The conventional thermostat 45 used in substantially all of today's air-conditioning and heat pump systems includes a red terminal for receiving input power via lead 65 which is one of the secondary coils of the control transformer 43, a white terminal for outputting heat cycle control signals, a yellow terminal for outputting cool air control signals, and a green terminal which goes "high" whenever the blower fan kicks on or is continually "high" if the thermostat 45 is set for continuous "ON" fan operation. A two-position switch 50 is used to represent the blower fan control means of a typical thermostat 45, and it is shown as being in the temperature controlled output switch position or AUTO position, rather than in the opposite "ON" switch position which is for continuous ON fan operation.

In FIG. 2, the conventional yellow and white terminals of the typical heat pump thermostat 45 are commonly connected together at node 107 which is then connected via lead 109 to another node 111. Node 111 is connected via lead 113 to the input of a conventional one-shot multivibrator or one-shot pulse-generating circuit 115 whose output is supplied via lead 117 to the "reset" input of a counter/timer 73. Node 111 is also connected, via lead 119, to a node 121, and then, via lead 123, to the control input of the condenser fan relay 41. Node 121 is also connected to the "enable" input $\overline{EN}$ of a third decoder 79, via lead 125; and to the "reset" input $\overline{R}$ of a first flip-flop 89, via lead 127 and lead 128; and to the inverting input of a conventional two-input logical AND gate or circuit 129 via node 126 and lead 131 having one inverting input and one non-inverting input.

The output of AND circuit 129 is connected to the other or second input of a two-input logical OR gate 101 via lead 133. The other or second non-inverting input of logical AND circuit 129 is supplied via lead 135 from the green output terminal of the thermostat 45, as previously described. The output of a first output driver circuit 93 is connected via lead 137 to the control input of the compressor contactor 39, and the output of a second output driver circuit 105 is connected via lead 139 to the control input of the blower fan relay 37.

The power supply 57 runs off the control voltage transformer 43 via lead 49 to node 51, lead 55 to node 56 and then via lead 58. The power supply output 59 is rectified and regulated down to 12 volts DC to run the control circuit in block 40.

The squarewave at the output of the pulse shaper 61, via lead 63, is fed into the clock input of a counter or timer 73 which counts the squarewave pulses off of the sixty-cycle AC line frequency to generate a digital clock signal. The counter/timer 73 runs continuously to count the input squarewave pulses and drive all three of the decoders 75, 77, and 79. A first output of the counter/timer 73 is connected to the input of a first Decoder A, designated by reference numeral 75, via lead 81; a second output of the counter/timer 73 is connected to the input of a second Decoder B, designated by reference numeral 77, via lead 83; and a third output of the counter/timer 73 is connected to the input of a third Decoder C, designated by reference numeral 79, via lead 85. In the preferred embodiment, the counter/timer 73 is a conventional 14 stage ripple carry binary counter.

The output of the first Decoder 75 is supplied via lead 87 to the "set" input of a first conventional flip-flop 89 whose "Q" output is connected via lead 91 to the input of a first output driver circuit 93. Similarly, the output of the second Decoder 77 is supplied via lead 95 to the "set" input of a second conventional flip-flop 97 whose Q output is taken via lead 99 and connected to one input of a two-input logical OR gate 101 whose output is connected via lead 103 to the input of a second output driver circuit 105. Lastly, the output of the third Decoder 79 is connected via lead 108 to the "reset" input of flip-flop 97.

In order to further understand the method and apparatus of the present invention, a typical cycle will be described hereinbelow. Initially, all of the motors are off, and nothing happens on any of the circuit outputs until the thermostat 45 sends a signal for cooling (or, conversely, a signal for heating), typically by sending control voltage or going "high" on the industry standard yellow and green terminals. The "high" signal on the yellow terminal indicates that the temperature within the desired area or space to receive conditioned air has deviated from the user-set temperature established on the thermostat 45 located in the desired area or space. The yellow terminal of the thermostat 45 goes "high" to indicate a need for cooling or cool conditioned air, while the green terminal goes "high" to signal the need to turn on the system blower to supply the cool or conditioned air from the air-conditioning or heat pump system to the desired area or space to be cooled. The "high" signal at the yellow terminal of thermostat 45 would override the "high" signal of the green terminal by the use of the logical AND gate 129. The "high" signal of the yellow terminal is connected via node 107 and lead 109 to node 111, and when the "high" signal at node 111 is supplied via lead 113 to the input of a one-shot pulse circuit 115, it generates a one-time "high" signal on lead 117 which resets the counter/timer 73 so it can immediately begin its counting cycle with the next clock pulse to arrive at the clock input via lead 63 from the pulse-shaping circuit 61. Since the one-shot output pulse of circuit 115 sends a "high" signal to the counter/timer 73, resetting it to zero, the counter/timer 73 begins counting the squarewave pulses at the clock input. Simultaneously, the node 111 supplies a signal on lead 119 to lead 123 to the input of the condenser fan relay 41 for initially starting the condenser fan motor to drive the fan and pre-cool the condensing unit portion of the air-conditioner system. Node 111 is also connected via lead 119 to node 121 and then via lead 125 to the "enable" input $\overline{EN}$ of the third Decoder 79 to cause the Decoder to output a "high" signal which is supplied, via lead 108, to reset the second flip-flop 97, and via node 121 to lead 127, node 126 and then via lead 131, to the inverting input of the logical AND gate 129. With a "high" at the inverting input, the AND gate is disabled so that the signal on lead 133 cannot go "high" to drive the output driver 105 via the logical OR gate 101. Lastly, node 126 is connected via lead 128 to the "reset" input $\overline{RE}$ of the first flip-flop 89, causing it to be reset.

The first, second and third Decoders 75, 77, and 79 are responsive to particular predetermined counts from the outputs of the counter/timer 73, via leads 81, 83, and 85, respectively, and as soon as the first Decoder 75 senses its particular count or Time "T1", its output goes "high", and this high signal is supplied via lead 87 to set the flip-flop 89 causing its Q output on lead 91 to go "high" to turn on the first output driver 93 causing its output to go "high". This "high" output from the output driver 93 is transmitted via lead 137 to energize or turn on the compressor contactor 39 which in turn turns on the compressor motor to start the production of cooling air and to pre-cool the evaporator. At this point in time, after the delay T1, the compressor begins to pre-cool or condition the air for delivery or supply, as known in the art.

Since the three outputs 81, 83, and 85 from the counter/timer 73 go to three Decoders 75, 77, and 79, respectively, each of the Decoders 75, 77, and 79 looks for a particular control pulse count. The first Decoder 75 looks for a pulse count of T1, and recognizes this pulse when it is generated so as to set the flip-flop 89 so that its output turns on the first output driver 93 which then turns on or energizes the compressor contactor 39, as described hereinabove. Later, Decoder 77 looks for a pulse count of T2, where $T2=T1+T$ and when the Decoder 77 receives or detects this pulse, its output goes "high" to set the second flip-flop 97 causing its Q output to go "high". This "high" is supplied via lead 99 to one input of the logical OR gate 101 and it passes therethrough to bring the "high" signal, via lead 103, to the input of the second output driver 105 causing its output to go "high" and energize the blower relay 37 to begin operation of the conditioned air delivery portion of the cycle.

The output drivers 93 and 105 are now maintained in the "on" state. When the thermostat 45 senses that the actual temperature in the conditioned zone or area has reached the desired level pre-set by the user, the signal at the yellow or cooling terminal is de-energized or goes "low". When this signal goes "low" or turns off, the one-shot pulse circuit 115 sends a second single pulse to the counter/timer 73 resetting it to zero so that it can begin a new count cycle. Simultaneously, when the signal at the yellow terminal of the thermostat 45 goes "low", this "low" is transmitted, via lead 109, node 111, and lead 119 to node 121. From node 121, the "low" signal is supplied via lead 123 to turn off or de-energize the condenser fan relay 41 which in turn shuts off the condenser motor 25 and stops the condenser fan 23. At the same time, from node 121, the "low" signal is transmitted, via lead 127, node 126 to lead 128 to the reset input $\overline{R}$ of flip-flop 89 causing it to reset and its output on lead 91 to go "low". This "low" turns off the output driver circuit 93 which, via lead 137, turns off or de-energizes the compressor contactor 39 which in turn shuts off the compressor motor and closes down the compressor cycle. Simultaneously, Decoder 79 is enabled by the "low" signal at node 121 and lead 125 so that it begins looking for a pulse T3 from the output of the newly reset counter/timer circuit 73. When it recognizes or identifies the T3 count, it resets the flip-flop 97 causing its Q output on lead 99 to go "low" for terminating the "high" signal from the output of the logical OR gate 101. At the time T3, the output of the logical OR gate goes "low" causing a "low" signal to arrive at lead 103 to the input of the second output driver 105 causing its output to turn off or go "low" thereby de-energizing the blower relay 37 so as to shut down the blower motor and blower fan at that time. The second output driver 105 will not receive a "high" signal on lead 103 unless the signal on the input lead 133 is also "high", but this signal is also turned off when the signal at the inverting input goes "low" via the "low" at the yellow terminal node 107 of the thermostat 45, unless the thermostat blower switch 50 is in the continuous on position, at which time the signal at the inverting input will be "low" so as to enable the AND gate 129 and the signal at the opposite or second input will be "high" so as to generate a "high" on output 133. This "high" signal is supplied via lead 133 to the second input of the logical OR gate 101 causing a "high" to appear on lead 103 and a "high" at the output of the second output driver 105 for continually operating or continually energizing the blower relay 37 for continuous fan operation. However, if the switch 50 is on temperature control, AUTO, or off, the blower is controlled strictly by the signal at the yellow/white terminal node 107 and is operated or turned off as described hereinabove.

The programmable timing of the components of the present control system are equipment and application dependent, for example: a typical 36,000 BTU package unit single installation air-conditioning system might program T1 for 72 seconds, T2 would be programmed for 21 additional seconds, and T3 for 90 seconds.

If, at any time, the green terminal of the thermostat 45 is turned on and the cooling or heating is not energized, the signal is passed through the logical AND gate 129, and it then passes through the logical OR gate 101 turning on the output driver 105 which in turn energizes the blower relay 37, as described previously. If the green terminal is continuously on and the thermostat 45 signals for cooling by the yellow terminal going "high", or heating, by the white terminal going "high", this signal will override the signal at the green terminal which enables the logical AND circuit 129 and turns off the output driver 105. It will stay off until the timing sequence previously described takes place again.

The above-described embodiment was presented for the purpose of illustration, but it will be understood, by those of ordinary skill in the art, that modifications can be made without departing from the spirit and scope of the present invention. For example, instead of a completely timed blower turn-on operation, Decoder 77 could look for a quick 10 second pulse, consequently turning on the output driver 105 and sending a signal to an optional temperature switch mounted on the evaporator coil 21 which could energize the blower relay 37 at a second predetermined set temperature. The same sequence can be used in the heating operation in central heat pump systems, as in the air-conditioning system described hereinabove.

It will be understood that the system of the present invention is embodied both in the system circuitry or circuit means of the present invention and also in the method of turning the various motors on and off in a timed sequence for optimizing energy efficiency while simultaneously achieving the other advantages of the present invention, as described previously. The control system of the present invention can be used, with only minor modifications or adaptations obvious to those skilled in the art with any conventional air-conditioning or heat pump systems presently being manufactured or presently installed and in use today. All such systems can have their efficiency maximized and achieve the other advantages of the present invention simply by wiring in the present circuit. It will be understood that the particular circuitry used is conventional and any logical circuitry performing similar functions could be used, as known to those skilled in this art. The invention involves the method and use of various circuit means for performing the defined functions specified herein.

It will be obvious to those skilled in the art that various modifications, changes, alterations, variations, substitutions, and the like, may be made in both the system and the method disclosed in the preferred embodiment of the present invention without departing from the spirit and scope thereof which is limited only by the appended claims.

I claim:

1. In conventional air-conditioning and heat pump systems normally including a compressor means, a compressor motor for operating said compressor means, a compressor contactor for turning said compressor motor on and off, an evaporator means, a conditioned air delivery blower fan, a blower fan motor for driving said blower fan, a blower relay for turning said blower fan motor on and off, a condenser means, a condenser fan, a condenser fan motor for driving said condenser fan, a condenser fan relay for turning said condenser fan motor on and off, a control transformer for converting sixty-cycle AC line voltage to control voltage AC power, an air duct system for delivering conditioned air and returning spent air from an area to be conditioned or controlled, a thermostat for automatic temperature control, and an improved energy efficient control system comprising:

first circuit means responsive to said thermostat indicating a need for conditioned air for initially energizing said condenser fan relay to turn on said condenser fan motor and drive said condenser fan for pre-cooling said condenser means and for preventing a high pressure or high stress compressor start-up;

second circuit means responsive to the elapse of a first predetermined period of time after the initiation of said pre-cooling of said condenser for energizing said compressor contactor to start said compressor motor for pre-cooling said evaporator, and a portion of the air in said duct system, for preventing a reverse temperature gain, for shortening the air production or "on" cycle time, and for providing protection for the compressor and the compressor motor;

third circuit means responsive to the elapse of second predetermined period of time after said first predetermined period of time for energizing said blower fan relay for driving said blower fan and supplying conditioned air to the area to be conditioned via said air duct system so as to initially deliver a built-up volume of conditioned air while providing additional protection for the blower fan and blower motor; and fourth circuit means responsive to a third predetermined period of time after said first and second predetermined periods of time and after said condenser motor and said compressor motor cycles off in response to a signal from said thermostat indicating that the user-selected temperature has been attained, for maintaining said blower fan on until substantially all conditioned air remaining in said ductwork system and said evaporator has been delivered and for turning said blower fan motor off at the expiration of said third predetermined period of time.

2. An improved energy efficient control circuit for use in a conventional air-conditioning or heat pump system including a compressor, a compressor motor for driving said compressor, a compressor contactor for turning said compressor motor "on" and "off", an evaporator means, a main blower fan, a blower fan motor for driving said blower fan, a blower fan relay for turning said blower fan motor "on" and "off", a condenser, a condenser fan for cooling said condenser, a condenser fan motor for driving said condenser fan, a condenser fan relay for turning said condenser fan motor "on" and "off", a control transformer means for converting sixty-cycle AC line voltage to control voltage AC power for operating the various components of the system, an air duct system for supplying conditioned air to a given space in which it is desired to have conditioned air and returning spent air to said evaporator means, and a control thermostat having a conventional first output terminal for normally supplying power thereto from said control transformer means, a conventional second output terminal for normally going "high" to turn "on" and initiate the cooling system cycle and "low" to turn "off" and end the cooling system cycle, a conventional third output terminal for normally going "high" to turn "on" and initiate the heating system cycle and "low" to turn "off" and end the heating system cycle, if included, and a fourth terminal for normally going "high" to indicate the need for blower fan operation, the improved energy efficient control circuit comprising:

first means for commonly connecting said second and third output terminals of said thermostat means together at a common thermostat output node, said node going "high" to generate a first control signal whenever said second terminal goes "high" in response to a thermostat command for cool conditioned air or said third terminal goes "high" in response to a thermostat command for heated conditioned air, said node going "low" whenever said thermostat detects that the actual temperature in the space being conditioned is equal to the user-selected temperature for turning "off" the supply of conditioned air;

second means responsive to said first control signal for initially energizing said condenser fan relay for turning the condenser fan motor "on" and driving said condenser fan to pre-cool the condenser;

pulse-shaping means responsive to the output of said control transformer means for continuously generating a sequence of pulses as a squarewave signal and outputting same;

counter/timer means responsive to said pulses of said squarewave signal for counting same and outputting count pulses indicative of said count;

third means responsive to said first control signal for initially resetting said counter/timer means for starting a first new count sequence at a time T0;

fourth means responsive to said counter/timer output for detecting a first count time T1 and outputting a second control signal in response to the attainment thereof:

fifth means responsive to said second control signal for energizing said compressor contactor to start said compressor motor and begin the compressor cycle;

sixth means responsive to said counter/timer output for detecting a second different and distinct count time T2 where $T2=T1+T$ and generating a third control signal in response to the attainment thereof;

seventh means responsive to said third control signal for energizing said blower fan relay, turning on the blower fan motor and operating the blower fan to begin delivering the build-up of pre-conditioned air to the space requiring same; and eighth means responsive to said thermostat output node and the signal at said fourth thermostat terminal for going "low" for indicating that the actual temperature in the controlled space is equal to the user-selected temperature for:

(1) immediately de-energizing said condenser fan relay for turning said condenser fan motor "off" and terminating the operation of said condenser fan;

(2) immediately resetting said counter/timer means to begin a new second count sequence;

(3) immediately resetting said fourth means to terminate said second command signal for turning "off" said compressor motor and said compressor;

(4) monitoring said second count sequence for detecting a third different and distinct count time T3 and generating a fourth control signal in response to the detection thereof; and (5) means responsive to said fourth control signal for de-energizing said blower fan relay for turning "off" said blower fan motor and terminating the operation of said blower fan.

3. The improved energy efficient control circuit of claim 2 wherein said first means includes a first electrical lead connecting said second output terminal of said thermostat to said common thermostat output terminal node, a second electrical lead connecting said third output terminal of said thermostat to said common thermostat output terminal node, and wherein said node goes "high" to generate said first control signal whenever said thermostat actuates either of said second and third output terminals indicating a need for conditioned air, either heated or cooled.

4. The improved energy efficient control circuit of claim 3 wherein said second means includes a third electrical lead directly connected between said common thermostat output terminal node and the input of said condenser fan relay, said condenser fan relay being responsive to said first control signal for energizing to turn "on" said condenser fan motor and drive said condenser fan for pre-cooling said condenser.

5. The improved energy efficient control circuit of claim 2 wherein said pulse-shaping means includes a conventional square-wave generator.

6. The improved energy efficient control circuit of claim 2 wherein said counter/timer means includes a 14 stage binary counter.

7. The improved energy efficient control circuit of claim 4 wherein said third means includes a one-shot pulse-generating circuit means having an input and an output, said one-shot pulse-generating circuit means being responsive to said first control signal at its input for generating a single output pulse at its output for resetting said counter/timer means to start a new counting cycle.

8. The improved energy efficient control circuit of claim 7 wherein said fourth means includes a first count detector having an input for receiving the timing count pulses from the output of said counter/timer means and means for detecting the count T1 and generating a logical "high" signal at the output thereof, said logical "high" signal respresenting said second control signal.

9. The improved energy efficient control circuit of claim 8 wherein said fifth means includes a first logical flip-flop means having a set input, a reset input and a Q output, said first flip-flop means being responsive to said second control signal at its set input for setting to output the logical "high" signal at its Q output, and further including a first output driver circuit means having an input and an output and being responsive to said logical "high" from said Q output of said first flip-flop means for generating drive current at its output for energizing said compressor contactor and starting said compressor motor to operate said compressor at the time T1.

10. The improved energy efficient control circuit of claim 9 wherein said sixth means includes a second count detector means for monitoring the output of said counter/timer means, detecting a count time T2, where T2=T1+T and generating a third control signal in response to the detection of T2.

11. The improved energy efficient control circuit of claim 10 wherein said seventh means includes a second flip-flop means having a set input, a reset input, and a Q output, said second flip-flop means being responsive to said control signal at its set input for setting to produce a logical "high" signal at its Q output, an output driver means responsive to the logical "high" signal at the Q output of said second flip-flop means for outputting drive current to energize said blower fan relay to turn "on" said blower fan motor and drive said blower fan to supply the built-up pre-conditioned air to said space to be conditioned via said airduct system.

12. The improved energy efficient control circuit of claim 11 wherein said eighth means for de-energizing said condenser fan relay includes said third electrical lead for supplying said "low" signal from said common thermostat output terminal node directly to the input of said condenser fan relay for de-energizing same to turn said condenser fan motor "off" and terminate the operation of said condenser fan.

13. The improved energy efficient control circuit of claim 11 wherein said eighth means for resetting said counter/timer means includes said one-shot pulse-generating circuit means which is further responsive to said "low" signal from said common thermostat output terminal node for generating a second single one-shot pulse for again resetting said counter/timer means to zero and beginning a second new count sequence at time T0.

14. The improved energy efficient control circuit of claim 13 wherein said eighth means for resetting said fourth means and turning "off" said compressor motor and said compressor includes a third count detector means having a count input, an enable input and a detector output, said third count detector means for monitoring said count pulses from the output of said counter/timer means at said count input, detecting the attainment of a third different and distinct predetermined count time T3 and generating a fourth control signal in response to the detection of T3, said second logical flip-flop means being responsive to said fourth control signal at its reset input for resetting to produce a logical "low" signal at its Q output, and wherein said eighth means further includes a logical gating circuit and a second output driver circuit means having an input and an output, said second output driving circuit means being responsive to said logical "low" signal gated to its input for terminating the generation of drive current and de-energizing said (compressor contactor) blower relay for turning "off" said (compressor) blower motor and deactuating said (compressor) blower fan at the time T3.

15. The improved energy efficient control circuit of claim 13 wherein said eighth means for monitoring includes a third count detector means responsive to the attainment of said count time T3 for generating a fourth count signal.

16. The improved energy efficient control circuit of claim 14 wherein said eighth means for de-energizing said blower fan relay includes a fourth electrical lead connecting the output of said third count detector means to the reset input of said second flip-flop means for resetting same in response to said fourth control signal for producing a logical "low" signal at its Q output, said logical "low" signal being transmitted to the input of said first output driver circuit means for terminating drive current therefrom and de-energizing said compressor contactor for turning "off" said compressor motor and deactuating the operation of said compressor.

17. The improved energy efficient control circuit of claim 16 wherein said eighth means for de-energizing said blower fan relay includes a second output driver circuit means having an input and an output and wherein said second flip-flop means is responsive to said fourth control signal at its reset input for producing a logical "low" signal at its Q output and gating means having its ouput connected to the input of said second output driver circuit means for producing a logical "low" signal at the output of said gating means for turning said second output drive circuit means "off" and terminating the drive current therefrom for de-energizing said blower fan relay for turning off said blower fan motor and said blower fan at time T3.

18. The improved energy efficient control circuit of claim 17 wherein said gating means includes a two-input logical OR gate having an OR gate output, one input of said logical OR gate being operably connected to the Q output of said second flip-flop means and the output of said logical OR gate being operatively connected directly to the input of said second output driver circuit means.

19. The improved energy efficient control circuit of claim 18 wherein said eighth means further includes a two-input logical AND gate having one inverted input, one non-inverted input, and an AND gate output, said AND gate output being operatively connected to the second input of said logical OR gate, the non-inverting input of said AND gate being connected to said common thermostat output node, and the inverted input of said logical AND gate being operatively connected to the fourth terminal of said thermostat such that said output of said logical AND gate remains "low" unless both (1) the signal at the fourth thermostat output terminal is a logical "high" and (2) the signal at the common thermostat output terminal node is a logical "low" meaning that the thermostat has ended the demand for conditioned air causing the signal at the common thermostat output terminal node to go to a logical "low" state but that the signal at the fourth thermostat output terminal is still "high" indicating that the user has switched the thermostat to a continous blower fan mode of operation.

20. A method of operating conventional air-conditioning and heat pump systems which normally include a condenser fan, a condenser fan motor for driving said condenser fan, a compressor means, a compressor motor for operating said compressor means, a blower fan, a blower fan motor for driving said blower fan, an evaporator means, a condenser means, an air duct system for delivering conditioned air to a space to be temperature conditioned and returning spent air for further conditioning, and a thermostat including means for setting a user-selected desired temperature, means for measuring the actual temperature in said space to be temperature controlled and outputting thermostat signals demanding that hot or cold conditioned air be delivered or that the delivery be stopped and for demanding that the blower fan be turned on and off, an improved method of optimizing the energy efficiency of the operation of said air-conditioning and heat pump systems by selectively sequencing the turn-on and turn-off times of the various motors, said improved method comprising the steps of:

(1) initially turning on the condenser fan when the thermostat demands the delivery of conditioned air for pre-cooling the condenser means and compressor means while simultaneously preventing high pressure or high stress compressor start-up;

(2) turning on the compressor to begin the conditioning cycle only after the passage of a time T1 to pre-cool the evaporator means for building up a supply of conditioned air while simultaneously (a) preventing a reverse temperature gain, (b) shortening the conditioned air production cycle, and (c) extending the life of the compressor motor and compressor means;

(3) turning on the blower fan after a second different and distinct predetermined period of time T2, where T2=T1+T and delivering the built-up supply of conditioned air to the space requiring same via said air duct system when said time T2 has elapsed;

(4) shutting off said compressor means and said condenser fan motor when the user-set thermostat is satisfied; and (5) maintaining the operation of the blower fan even after the thermostat demands shutting off the production of conditioned air for a third predetermined period of time T3 to provide substantially total production air recovery and energy utilization.

* * * * *